United States Patent [19]

Wallace

[11] 3,954,117

[45] May 4, 1976

[54] INFLATABLE UMBRELLA

[76] Inventor: William E. Wallace, 1851 Arlington St., Sarasota, Fla. 33579

[22] Filed: Jan. 23, 1975

[21] Appl. No.: 543,643

[52] U.S. Cl. ..... 135/20 B; 135/46 T
[51] Int. Cl.[2] ..... A45B 19/02; A45B 19/04
[58] Field of Search ..... 135/19.5, 20 B, 46 T

[56] References Cited

UNITED STATES PATENTS

| | | | |
|---|---|---|---|
| 1,397,789 | 11/1921 | Stonestreet | 135/20 B |
| 1,411,560 | 4/1922 | Beaty | 135/20 B |
| 2,172,549 | 9/1939 | Solomon | 135/20 B |
| 2,625,946 | 1/1953 | Kaston et al. | 135/20 B |
| 2,753,878 | 7/1956 | Halberstam | 135/20 B |
| 3,538,928 | 11/1970 | Price et al. | 135/20 B |

*Primary Examiner*—Werner H. Schroeder
*Assistant Examiner*—Conrad L. Berman
*Attorney, Agent, or Firm*—Stein, Orman, and Pettis

[57] ABSTRACT

A pocket-sized inflatable umbrella of the type primarily intended for disposal after a single use including a thin flexible plastic sheet having air passages formed therein, wherein the sheet is dimensioned and configured to substantially define a hemisphere surrounding the head and/or shoulders of the user when inflated. The sheet is fixedly attached to a telescoping sleeve, both of which fit into a housing of a suitable size and configuration for carrying in a pocket or purse. When the sleeve is extended from the housing, the plastic sheet is inflated, and the housing serves as a handle for the umbrella.

10 Claims, 10 Drawing Figures

FIG. 1
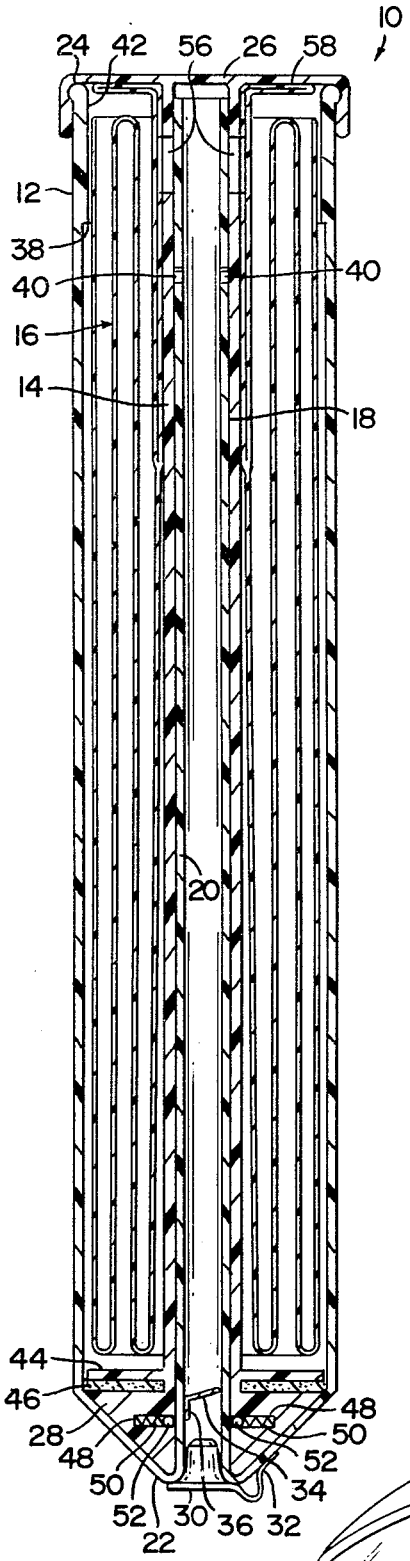
FIG. 8
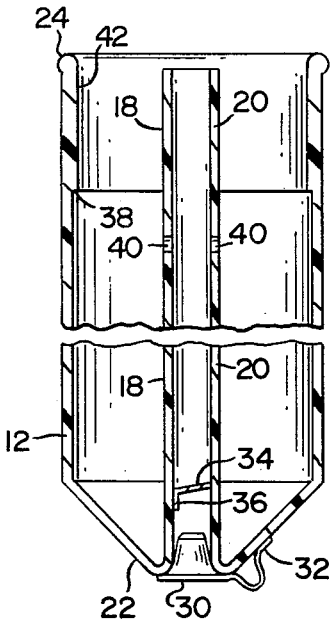
FIG. 9
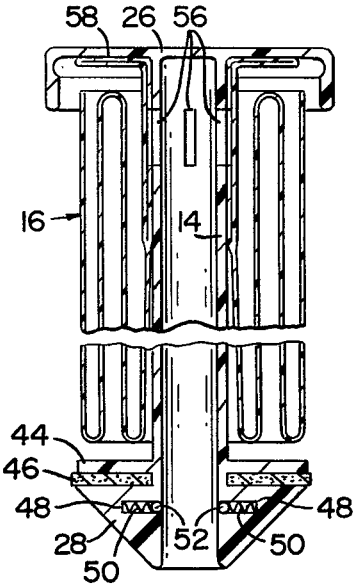
FIG. 4
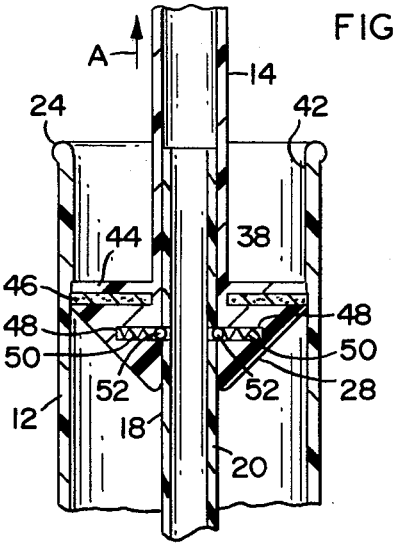
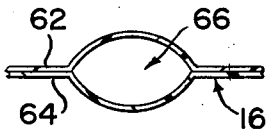
FIG. 6
FIG. 2
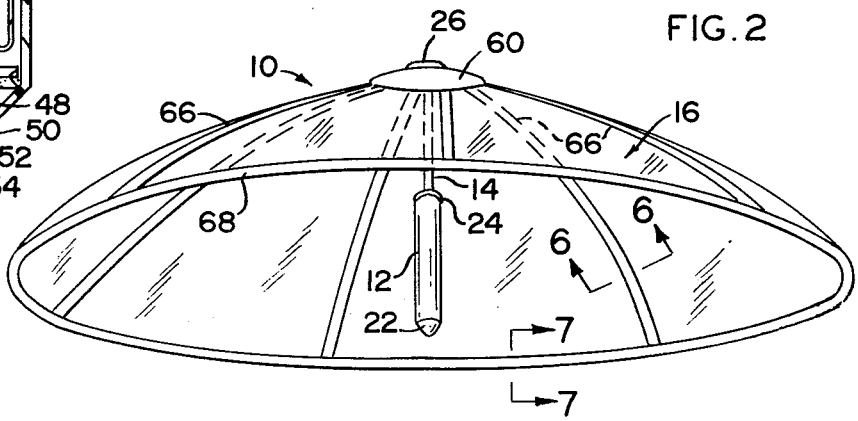

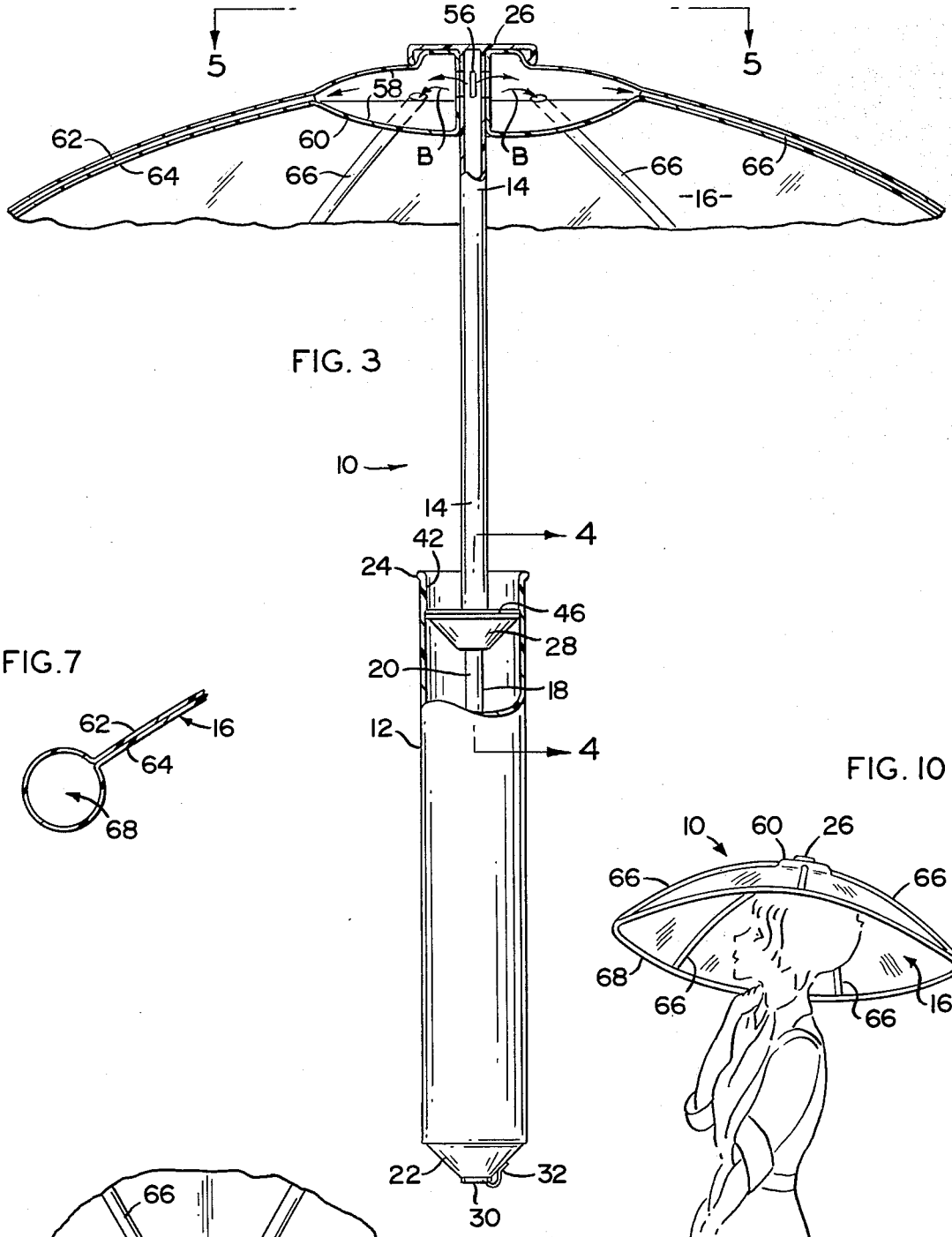
FIG. 3
FIG. 7
FIG. 10
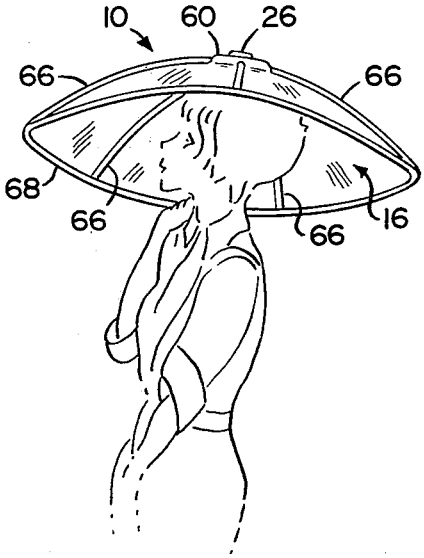
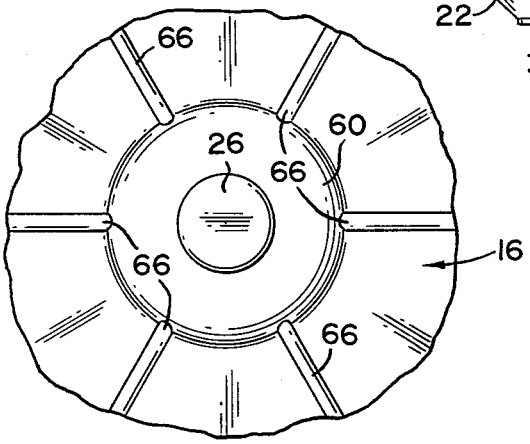
FIG. 5

INFLATABLE UMBRELLA

BACKGROUND OF THE INVENTION

1. Field of the Invention

This invention relates to a pocket-sized umbrella wherein the protector canopy is formed from a flexible material and includes at least one fluid passage formed therein, whereby the protector assumes a predetermined configuration upon inflation.

2. Description of the Prior Art

Numerous umbrella designs and constructions are well known in the prior art. Certain ones of these umbrellas are classified as emergency or pocket-sized umbrellas for use when inclement weather is unexpectantly encountered. By their very nature, two principal problems are encountered with such prior art umbrella constructions. First, the canopy, frame and handle of prior art umbrellas frequently render them unsuitable for convenient pocket carrying. Second, in an attempt to make such umbrellas of a small size, they provide extremely limited coverage or protection from the elements.

In an attempt to provide more complete protection to the user, prior art devices of an inflatable nature have been developed. However, such prior art inflatable umbrellas seem unduly complicated in their means for inflating the umbrella, and retaining it in an inflated disposition. One such prior art inflatable umbrella is disclosed in U.S. Pat. No. 2,625,946. Another example is disclosed in U.S. Pat. No. 2,810,391. However, both these prior art devices illustrate that prior art inflatable, pocket-sized umbrellas are generally complex and apparently expensive to make. From an economic standpoint, it has therefore been impractical to dispose of umbrellas comprising such relatively complicated structures after a single use.

Thus, it is apparent that a need exists for an inflatable pocket-sized umbrella with a canopy of sufficient size to protect at least the head and shoulder area of the human torso. In addition, the design and construction of such an umbrella, as well as the material from which it is made, must allow the umbrella to be purchased for a price sufficiently inexpensive to allow disposal after a single use.

SUMMARY OF THE INVENTION

The present invention relates to an umbrella structure designed and constructed to protect the user from inclement weather. To enhance the protection capabilities of the umbrella, its canopy is inflatable to a predetermined configuration, and the device is provided with specific means for accomplishing this inflation as well as retaining the canopy in an inflated configuration. The umbrella is pocket-sized and, while it may be reused, it is primarily intended for disposal after a single use.

Accordingly, the inflatable umbrella of the present invention comprises a flexible sheet which serves as a canopy or protector means. The protector means is formed from two sheets of the flexible material, such as plastic, and the two sheets are sealed one to another at predetermined points in such a fashion as to define air passages therebetween, whereby the protector may be inflated. It is preferred that this sealing and other forming of the protector be accomplished to define a predetermined configuration thereof. Such predetermined configuration is preferably disclosed as a dome-like shape to accomplish maximum protection to the user. It should be noted that other shapes or configurations could be utilized dependent upon the particular application.

As will be explained in greater detail hereinafter, the protector means or canopy is folded upon itself around a sleeve, and the protector and sleeve are disposed within a housing to provide an umbrella which may be carried in the user's pocket. Inasmuch as it is well known that items of identical substance tend to cohese when they are placed next to each other, one embodiment of the present invention may comprise the application of a cohesion inhibitor to the protector means to aid in inflating and opening the device. If such is desired, the cohesion inhibitor of my presently co-pending application Ser. No. 536,550, filed Dec. 26, 1974, may be utilized.

The central, or hub, portion of the protector is fixedly attached in fluid communicating relation to a sleeve, which sleeve serves as a support element for the umbrella in use. The sleeve also comprises a fluid passage whereby inflating fluid may be introduced into the passages formed in the protector. The sleeve is mounted in surrounding, sliding relation to a fluid conduit integrally formed within the housing for the deflated, closed umbrella. This housing also serves as the handle for the umbrella when it is opened and inflated for use.

One end of the sleeve comprises a cap for the deflated, closed umbrella, and the other end of the sleeve includes locking means whereby the sleeve may be held in an open, extended relationship to the housing.

Closure means, preferably comprising a removable plug, are provided in the base of the housing, whereby its fluid conduit may be selectively opened and closed. Additionally, it may be desirable to mount a one-way valve within the fluid conduit. This valve would be disposed to allow the flow of inflating fluid into the umbrella, and also to prevent its escape therefrom.

In use, the entire inflatable device is removed from the user's pocket or purse. In a single motion, the cap is removed and the sleeve and attached protector are extended. Locking means formed at the base of the sleeve engage corresponding stops formed within the housing to hold the sleeve and protector in an extended position. Next, the closure means is removed from the base of the housing. The user then introduces the inflating fluid, such as exhaled air, into the aperture at the base of the housing. The air passes through the fluid conduit, through the sleeve, and into the protector fluid passage. Assuming the presence of a one-way valve within the fluid conduit, air introduced beyond this point cannot thereafter escape. The user continues blowing into the aforesaid aperture until the device is fully inflated into a dome-like shape. He then replaces the closure means.

Following use, the umbrella is deflated, as by tearing the protector, and it is simply disposed of. Alternatively, and assuming that no valve is mounted with the fluid conduit, the umbrella may be deflated by removing the closure means. After such deflation, the protector may be folded around the sleeve, and the sleeve and protector may be reinserted in the housing. Then the sleeve cap is closed, and the closure means is replaced. The umbrella is now suitable for re-use.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a longitudinal sectional view of the umbrella of the present invention in its closed, deflated configuration.

FIG. 2 is a perspective view of the umbrella of the present invention inflated and ready for use.

FIG. 3 is a side view, partially in section, of the inflated umbrella.

FIG. 4 is a sectional detail taken along line 4—4 of FIG. 3.

FIG. 5 is a detail partial cutaway view of the cap and protector taken along line 5—5 of FIG. 3.

FIG. 6 is a detail sectional view of a radial passage taken along line 6—6 of FIG. 2.

FIG. 7 is a detail sectional view of a peripheral passage taken along line 7—7 of FIG. 2.

FIG. 8 is a longitudinal sectional view of the housing means of the present invention.

FIG. 9 is a longitudinal sectional view of the sleeve means and deflated protector means of the present invention.

FIG. 10 is a view of the inflatable umbrella in use.

Similar reference characters refer to similar parts throughout the several views of the drawings.

DETAILED DESCRIPTION

As best seen in FIG. 1, the inflatable umbrella, generally indicated as 10, includes housing 12 having a substantially elongated configuration of sufficient longitudinal dimension to house sleeve 14 and protector 16. Integrally formed within housing 12 is fluid conduit 18. Fluid conduit 18 is defined by side walls 20 extending from base 22 of housing 12 to points substantially adjacent the plane defined by top 24 of housing 12.

Cap 26 is formed at one end of sleeve 14 in corresponding relation to top 24 of housing 12. As shown in FIG. 1, when sleeve 14 is depressed into housing 12 around fluid conduit 18, cap 26 seals the top of umbrella 10. Locking means 28 is formed at the other end of sleeve 14 and is correspondingly configured as base 22 so as to fit therein.

Finally, and still with reference to FIG. 1, closure means comprising plug 30 is attached by tab 32 to base 22 in sealing/unsealing relation to fluid conduit 18. Additionally, valve means comprising one way valve 34 may be mounted within fluid conduit 18 to regulate the flow of inflating fluid therethrough. One end 36 of valve 34 is fixedly attached to side wall 20 so as to regulate the flow of fluid through fluid conduit 18.

FIG. 8 more clearly depicts the structural details of housing 12, while FIG. 9 correspondingly depicts the details of sleeve 14 with protector 16 attached thereto.

With particular regard to FIG. 8, it can be seen that housing 12 further includes stop means comprising annular lip 38 and dimple 40. While the exact operation of these elements and their cooperation with locking means 28 will be described in greater detail hereinafter, it can be seen that annular lip 38 is formed on the inside 42 of housing 12 a predetermined distance downward from top 24. Dimple 40 is similarly formed on side wall 20 of fluid conduit 18.

Turning now to FIG. 9, further structural details of sleeve 14 and protector 16 are shown. In FIG. 9, it can be seen that locking means 28 includes annular ledge 44 integrally formed on sleeve 14 and substantially transverse thereto. A gasket 46 formed from a resilient material is placed in locking means 28 just below annular ledge 44. Finally, channels 48 are formed in locking means 28. Disposed within each of the channels 48 are spring 50 and a ball 52. Spring 50 normally urges ball 52 inwardly. Finally, FIG. 9 discloses the formation of aperture 56 at the top of sleeve 14. It is this aperture 56 which allows inflating fluid to enter protector 16.

Also as shown in FIG. 9, a double-walled portion 58 of protector 16 is fixedly attached on the inside of cap 26 and along a portion of sleeve 14 down to a point below aperture 56. The exact purpose of this construction will be described hereinafter with particular regard to the drawing of FIG. 3.

Turning now to FIG. 4, there is disclosed therein the interaction of the stop means of housing 12 and the locking means 28 of sleeve 14. It is by virtue of this interaction that umbrella 10 is retained in the open, extended position illustrated in FIGS. 2, 3 and 10. As shown in FIG. 4, sleeve 14 has been extended outwardly from within housing 12 as shown by arrow A. FIG. 4, along with FIG. 1, further clearly shows that sleeve 14 is mounted within housing 12 in surrounding relation to side wall 20 of fluid conduit 18. Sleeve 14 is prevented from being removed completely from within housing 12 by the interaction of annular lip 38 and annular ledge 44. Gasket 46 serves to enhance the fluid-tight integrity of umbrella 10 by abutting inside 42 of housing 12. Sleeve 14 is held in an extended, open position by the engaging of ball 52 in dimples 40. Because springs 50 urge balls 52 inwardly, when sleeve 14 is extracted sufficiently to align balls 52 with dimples 40, they seat themselves therein, holding sleeve 14 in the desired position. This position is most clearly illustrated in FIG. 3.

FIG. 3 clearly illustrates the construction of protector 16. As shown therein by arrows B, inflating fluid exhausts through aperture 56 into double-walled portions 58 of protector 16. This results in inflation of hub passage 60. Protector 16 is further shown as comprising two layers 62 and 64 of flexible material. Layers 62 and 64 are left unsealed at predetermined points to define radial passages 66. Radial passages 66, as shown in FIG. 3, are in fluid communicating relation to hub passage 60. Finally, as illustrated in FIG. 2, radial passages 66 are in fluid communicating relation with similarly configured peripheral passage 68. Thus, inflating fluid passing from aperture 56 fills hub passage 60, radial passages 66, and peripheral passage 68, successively. This results in complete inflation of protector 16 to assume a predetermined dome-like configuration. As set forth above, the particular configuration of protector 16 may be varied dependent upon the relative disposition and configuration of both passage 60, radial passage 66 and peripheral passage 68. Details of the construction of radial passages 66 and peripheral passage 68 are shown in FIGS. 6 and 7, respectively. A detail of the inflated protector 16 at the top of umbrella 10 is presented in FIG. 5.

Inflatable umbrella 10 is operated in the following fashion. Typically, umbrella 10 is carried in a user's pocket or purse. When its use is called for, it is removed and cap 26 is removed from top 24 of housing 12. The cap is pulled outwardly, resulting in the extraction of sleeve 14 and protector 16 from inside housing 12. As previously explained, annular ledge 44 engages annular lip 38 to prevent complete removal of sleeve 14. Simultaneously therewith, springs 50 force balls 52 into dimples 40. This locks sleeve 14 in an extended, open position. Umbrella 10 is now ready for inflation.

Plug 30 is removed from base 22 of housing 12, and the user exhales into fluid conduit 18. The inflating fluid passes through fluid conduit 18, through the interior of sleeve 14, and out of aperture 56. Continued introduction of the inflating fluid results in successive inflation of hub passage 60, radial passages 66, and peripheral passage 68. Upon complete inflation, umbrella 10 will assume the dome-like configuration illustrated in FIG. 2. Deflation of umbrella 10 is prevented by reinserting plug 30 into fluid conduit 18 upon full inflation of protector 16. Alternatively, as previously described, premature deflation is prevented by means of one way valve 34. Umbrella 10 is now ready for use as suggested in FIG. 10. In this position, housing 12 serves as a handle for umbrella 10.

It will thus be seen that the objects made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all the generic and specific features of the invention herein described, and all statements of the scope of the invention, which, as a matter of language, might be said to fall therebetween.

Now that the invention has been described, what is claimed is:

1. An inflatable umbrella, said umbrella comprising: a housing means comprising an elongated tube and including fluid conduit means formed within said housing and extending substantially coincidental with the longitudinal dimension of said housing means; sleeve means movably disposed within said housing means, at least a portion of said sleeve means being disposed in surrounding relation to said fluid conduit means, said sleeve means comprising cap means formed at one end thereof in engaging relation to the top of said housing means and locking means formed on said sleeve means in cooperative relation to said housing means whereby said sleeve means may be held in an open, extended relationship to said housing means; and protector means formed from a flexible material including at least one fluid passage formed therein, at least a portion of said protector means being attached in fluid communicating relation to said sleeve means, whereby a fluid may be introduced through said fluid conduit means, through said sleeve means, and through said one fluid passage to inflate said protector means to a predetermined configuration; said housing means further comprising stop means formed thereon in engaging relation to at least a portion of said locking means when said sleeve means is extended from within said housing means, said stop means comprising at least one dimple formed on the outside of said fluid conduit means a predetermined distance from the top end thereof.

2. An umbrella as in claim 1 wherein said housing means further comprises closure means movably disposed on the base of said housing means in corresponding relation to one end of said fluid conduit means, whereby said fluid conduit means may be selectively opened and closed.

3. An umbrella as in claim 1 wherein said locking means comprises at least one spring lock means mounted in engaging relation to said one dimple when said sleeve means is extended from within said housing means.

4. An umbrella as in claim 1 wherein said locking means comprises a gasket means disposed in abutting relation to the interior of said tube.

5. An umbrella as in claim 1 wherein said fluid conduit means further comprises valve means mounted therein whereby the flow of fluid therethrough may be regulated.

6. An umbrella as in claim 5 wherein said valve means comprises a one-way valve disposed to permit fluid flow into said umbrella.

7. An umbrella as in claim 1 wherein said stop means comprises an annular lip formed on the inside of the top of said housing means.

8. An umbrella as in claim 7 wherein said locking means comprises an annular ledge formed in substantially transverse relation to said sleeve means and in engaging relation to said lip when said sleeve means is extended from within said housing means.

9. An umbrella as in claim 1 wherein said protector means includes a plurality of fluid passages formed therein, each one of said plurality being in fluid communicating relation to another of said plurality.

10. An umbrella as in claim 9 wherein said plurality of fluid passages comprise a hub passage formed at substantially the mid-point of said protector means and fixedly attached to said sleeve means in fluid communicating relation thereto; a plurality of radial passages extending in fluid communicating relation from said hub passage to points substantially adjacent the periphery of said protector means; and a peripheral passage formed circumferentially about the periphery of said protection means in fluid communicating relation to each of said plurality of said radial passages.

* * * * *